US005582360A

United States Patent [19]

Herman

[11] Patent Number: 5,582,360

[45] Date of Patent: Dec. 10, 1996

[54] ADJUSTABLE LENGTH RIBBON CUTTING SYSTEM

[76] Inventor: Marc B. Herman, P.O. Box 280775, Northridge, Calif. 91328

[21] Appl. No.: 298,229

[22] Filed: Aug. 29, 1994

[51] Int. Cl.[6] ..... B65H 18/04; B65H 75/24

[52] U.S. Cl. ..... 242/527.5; 242/537; 242/577

[58] Field of Search ..... 242/526, 527, 242/527.5, 527.6, 527.7, 537, 571, 577.1, 577.2, 577.3, 597.8, 127, 613.3, 577

[56] References Cited

U.S. PATENT DOCUMENTS

| | | | |
|---|---|---|---|
| 28,297 | 5/1860 | Palmer et al. | 242/577.3 |
| 325,394 | 9/1885 | Cavalli | 242/557.2 |
| 405,411 | 6/1889 | Heysinger | 242/127 |
| 556,592 | 3/1896 | Trachsel et al. | 242/597.8 |
| 1,963,644 | 6/1934 | Bronander | 242/527.5 |
| 2,073,420 | 3/1937 | Johnston | 242/527.5 |
| 2,105,707 | 1/1938 | Stancliff | 242/527.5 |
| 2,353,640 | 7/1944 | Bishop . | |
| 3,591,904 | 7/1971 | Rosene . | |
| 3,816,888 | 6/1974 | Rather, Jr. . | |
| 3,854,179 | 12/1974 | Montoya . | |
| 3,892,369 | 7/1975 | Fujawa | 242/597.8 |
| 4,032,052 | 6/1977 | Bates, Jr. . | |
| 4,337,578 | 7/1982 | Seals . | |
| 4,616,769 | 10/1986 | Steiger et al. . | |

FOREIGN PATENT DOCUMENTS

| | | | |
|---|---|---|---|
| 1381861 | 1/1975 | United Kingdom | 242/577 |

*Primary Examiner*—John M. Jillions

*Attorney, Agent, or Firm*—Merchant, Gould, Smith, Edell, Welter & Schmidt

[57] ABSTRACT

An adjustable ribbon cutter for cutting large quantities of rolled ribbon quickly and uniformly to selected lengths is disclosed. Two posts extend upwardly from base elements attachable or adherent by weight to a table at different selectable spaced apart locations, the distance between which is established by indicia on the table or a measuring element. Ribbon is continuously wrapped around the spaced apart posts for a selected number of turns. Then all the turns can be cut somewhere along the length to produce a plurality of uniformly cut ribbon lengths. The length of the final ribbon cuts depends only upon the length of the table or flat surface. Further, the posts, themselves can be of telescoping construction to allow compact storage, and can be tapered to allow seating of the ribbons without slippage.

15 Claims, 6 Drawing Sheets

ADJUSTABLE LENGTH RIBBON CUTTING SYSTEM

BACKGROUND OF THE INVENTION

1. Field of the Invention

The present invention relates to devices for cutting ribbons to length and more particularly, to an adjustable length ribbon cutter for cutting large quantities of rolled ribbon quickly and uniformly.

2. Background of the Invention

Stores which provide balloons in great quantities require decorative ribbons in large rolls of 500 foot or more lengths. The rolls of ribbons are periodically cut at the balloon store into a ribbon of a given length of four to seven feet. Cutting the rolls of ribbons to a preselected ribbon length is a time consuming and aggravating task. A typical method for preparing cut lengths of ribbon is to use a ruler or yardstick. An end of the ribbon roll is laid along the ruler or yardstick and cut to the desired length. If a length of ribbon longer than the measuring device is required, the measuring device must be incrementally moved along the ribbon, or the ribbon moved along the measuring device. Further, the previous relative location of the yardstick or ruler and ribbon must be marked so that the accumulated measurements total the desired length. Thus, this method described above is a time consuming and aggravating task and prone to errors.

However, devices have been established for measuring lengths of yarn and the like as disclosed in U.S. Pat. No. 4,337,578 issued to Seals on Jul. 6, 1982. The device includes an elongated base member with a fixed first position post and a second movable post. The second post is moved toward and away from the fixed first post to a preselected position along the base for measuring lengths of yarn and the like. A complete turn of yarn encompassing both posts measures the desired length of the yarn.

Nevertheless, this method has several drawbacks. First, the long length of the base is inconvenient for handling and storage. Second, when a long length of yarn is wrapped around the two posts many times, there is a high likelihood that the yarn will slip off the posts because the posts are vertically straight. Third, only a limited length of yarn can be cut since the distance between the posts is limited by the total length of the device.

Whatever the merits of the system described above, it does not achieve the objectives and advantages of the present invention.

SUMMARY OF THE INVENTION

To overcome the limitations in the prior art described above, and to overcome other limitations that will become apparent upon reading and understanding the present specification, the present invention discloses an adjustable ribbon cutter for cutting large quantities of rolled ribbon quickly and uniformly to selected lengths. Two posts extend upwardly from base elements attachable or adherent by weight to a table at different selectable spaced apart locations, the distance between which is established by indicia on the table or a measuring element. In one form, each post includes a clamp or suction cup device for attachment to the surface. Ribbon can then be wrapped repeatedly around the spaced apart posts for a selected number of turns. Then all the turns can be cut somewhere along the length to produce a plurality of uniformly cut ribbon lengths. The length of the final ribbon cuts depends only upon the length of the table or flat surface. Further, the posts themselves can be of telescoping construction to allow compact storage, and can be tapered to allow seating of the ribbons without slippage.

In a second example, the base comprises a center section housing pivotable and telescoping arms extending from a center hub, with posts at the ends of the arms. The two arms are slidably movable to provide any desired total length between the posts, determinable by indicia on the base and arms. The center section provides a swing link for collapsing the device to a short length determined by the length of the collapsed arms.

In a third example, the base section is linear, and the telescoping arms can be contrasted into it after use. Again, indicia along the base and arms enable determination of the cutting length. Screw clamps can be employed to fix the length of extension during the ribbon wrapping step.

DETAILED DESCRIPTION OF THE INVENTION

Figure 1A:
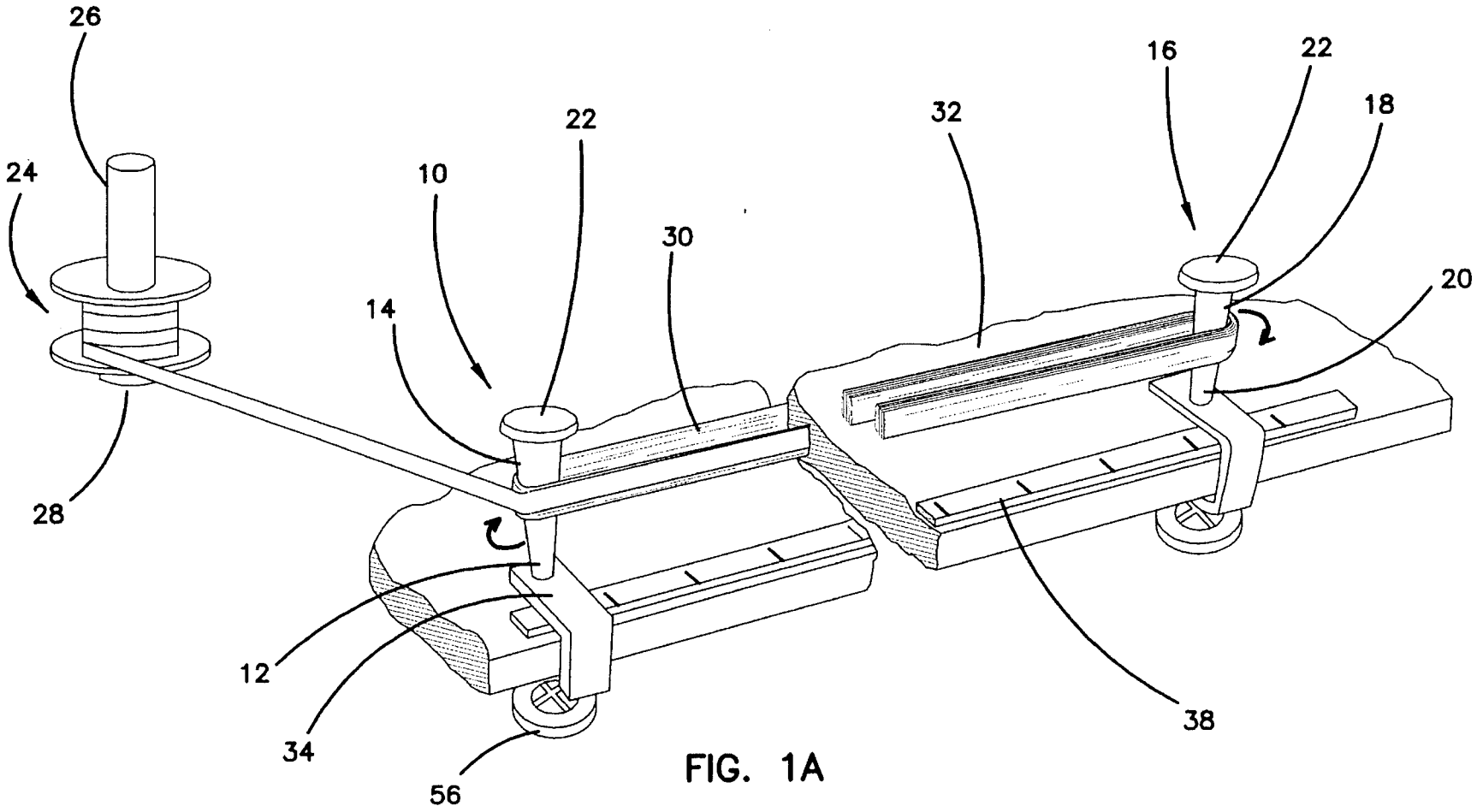
FIG. 1A illustrates a perspective view of one example of a ribbon cutter in accordance with the present invention.
Figure 1B:
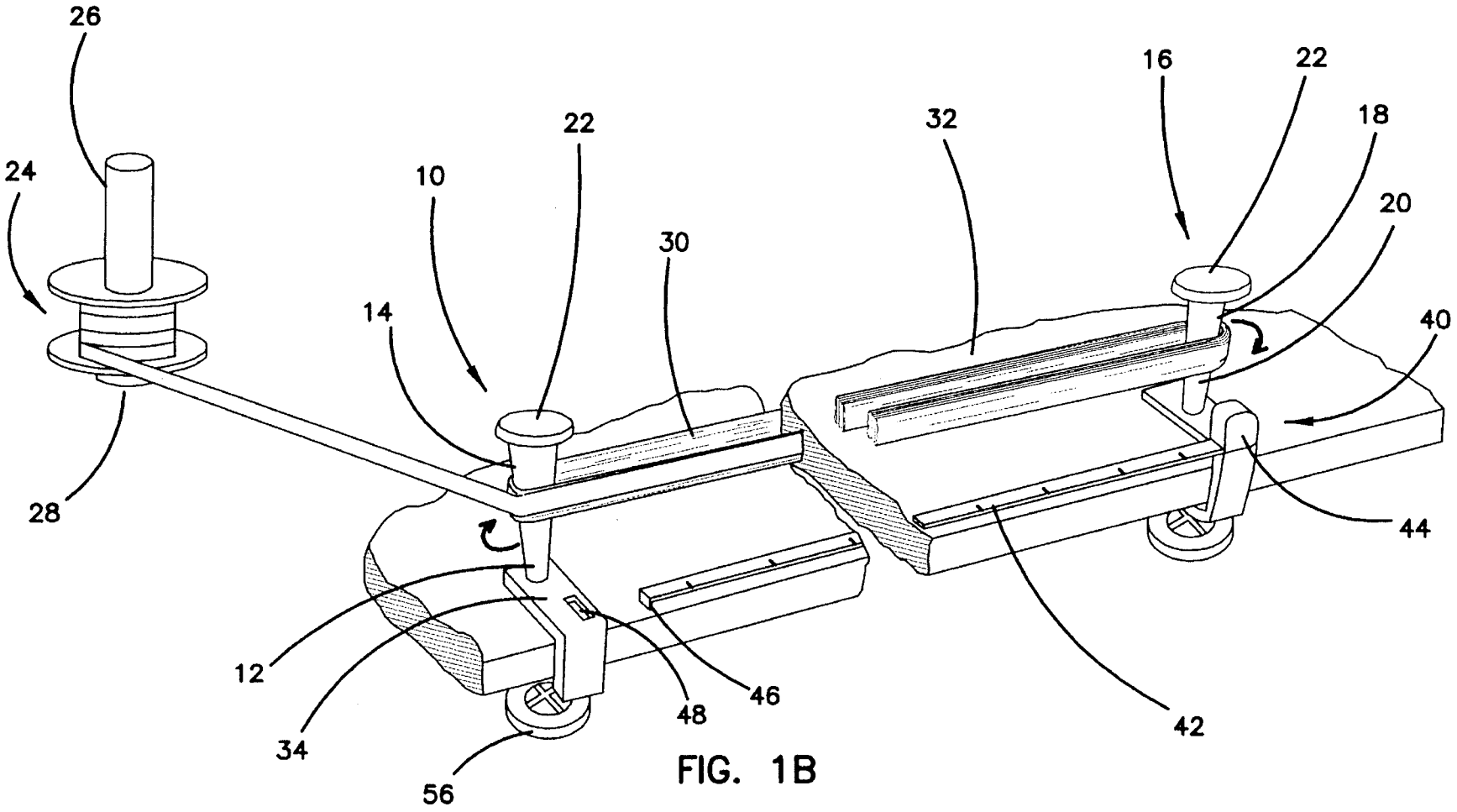
FIG. 1B illustrates a perspective view of another example of a ribbon cutter in accordance with the present invention.

FIGS. 1A and 1B illustrate a perspective view of the ribbon cutter of the present invention. A first post 10 vertically extends from a bottom 12 to a top 14. A second post 16 is identical to the first post 10 and is spaced apart a selectable distance from the first post 10. Both posts 10 and 16 have upwardly diverging shapes such that they have thicker sections 14 and 18 near the top of each respective post and thinner sections 12 and 20 near the bottom of each respective post. Thus, as the posts 10 and 16 extend vertically upward, posts 10 and 16 axially taper outward. Further, both posts 10 and 16 have a flanged cap 22 at the top of each respective post. When the posts 10 and 16 are spaced apart, a roll of ribbon 24 connected to a winding rod 26 having a lock cap 28 can be continuously wrapped 30 around both posts 10 and 16 a predetermined number of times. The tapered portions 12, 14, 18 and 20 on each respective post aid in containing the wrapped ribbon 30 around the posts by preventing the wrapped ribbon 30 from slipping off the posts 10 and 16. Also, flange cap 22 prevents wrapped ribbon 30 from slipping off the top of each respective post 10 and 16.

Each post 10 and 16 has a coupling device located at the bottom 12 and 20 of each respective post 10 and 16 for attachment to a supporting table 32. The coupling device can be a C-clamp 34 or a suction cup 36 (FIG. 2B). The C-clamp 34 securely couples each post 10 and 16 to the table 32 or other support so that the roll of ribbon 24 can be continuously wrapped 30 in multiple loops around the two posts 10 and 16. FIG. 1A illustrates a measurement indicia device 38 located between the first post 10 and the second post 16 for indicating the length of each ribbon strip to be cut. FIG. 1B illustrates an alternative measurement indicia device 40 located on one post 16. The measurement indicia device 40 indicates the distance between the posts 10 and 16. Tape 42 is extended from body 44 and latched by hook 46 to notch 48 on opposite post 10.

In order to make numerous cuts of identical length ribbon strips, the desired length of each ribbon strip to be cut is determined. The first post 10 is spaced apart a selectable distance from the second post 16 by using either indicia device 38 or 40 to measure the distance between the two respective posts 10 and 16. Since the support device 32 can be any length, the posts 10 and 16 can be spaced apart from each other any distance within the available length of distances, which are minutely variable. The C-clamp 34 is then securely coupled to the support device 32 to prevent each respective post 10 and 16 from moving. Next, the roll of ribbon 24 is continuously wrapped 30 a predetermined number of times around each respective side post 10 and 16. Finally, the loops of wrapped ribbon 30 are simultaneously cut at a predetermined location between the two posts 10 and 16 to effectuate a plurality of cut ribbon strips of identical selected length.

Figure 2A:
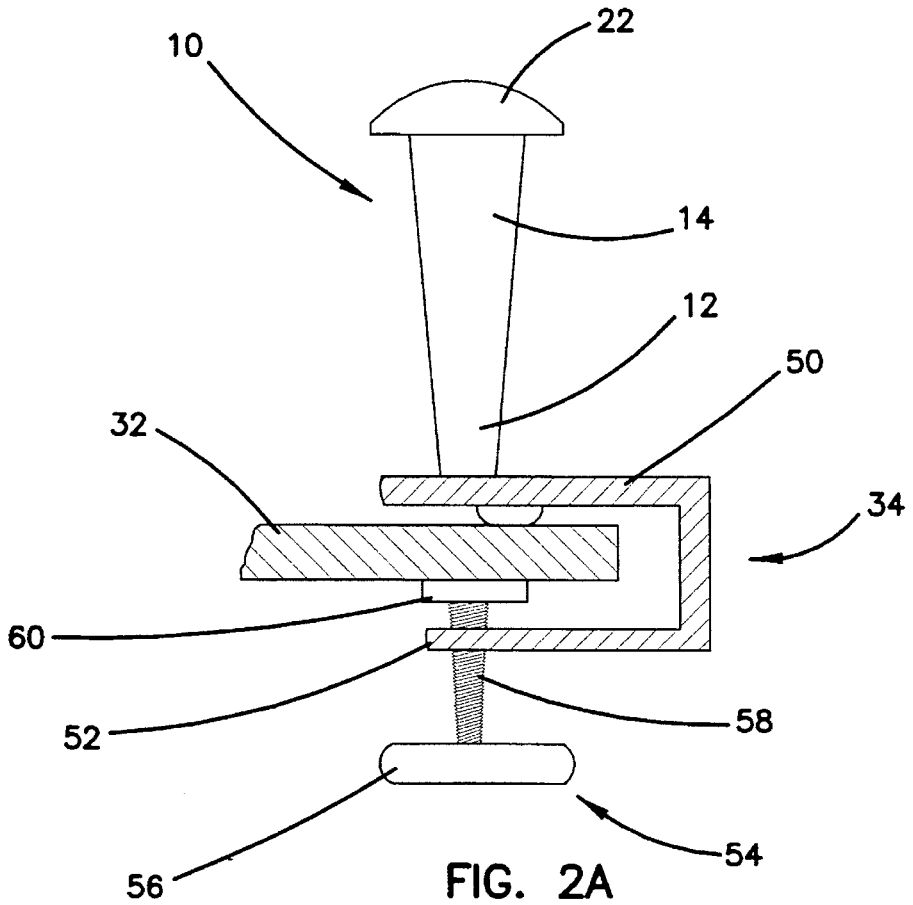
FIG. 2A is a side sectional view of the device of FIGS. 1A and 1B employing a C-clamp arrangement.
Figure 2B:
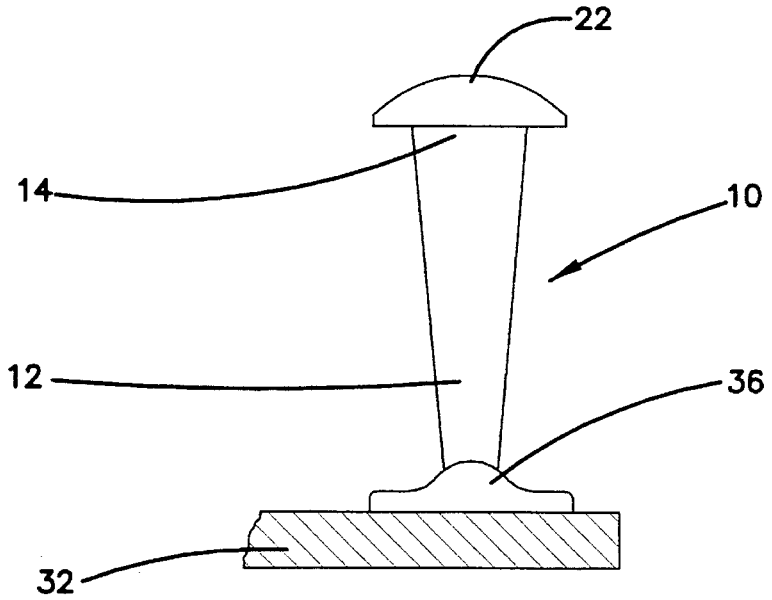
FIG. 2B is a side sectional view of the device of FIGS. 1A and 1B employing a suction cup arrangement.

FIG. 2A is a detailed side view of the C-clamp 34 used as a coupling device. C-clamp 34 includes a C-shaped member having a top section 50 and a bottom section 52 which receives the support 32 between each respective section 50 and 52. Screw clamp 54 is attached to the bottom section 52 of C-clamp 34. Screw clamp 54 includes a head 56, threads 58, and a coupler 60. Screw clamp 54 is threaded toward upper section 50 by threads 58 through bottom section 52 to urge coupler 60 against support 32. This pressing engagement between coupler 60 and support 32 securely holds C-clamp 34 of posts 10 and 16 to support 32.

FIG. 2B illustrates suction cup 36 connected to post 10 at the bottom rear tapered section 12. Suction cup 36 is attached to support 32 by pressing suction cup 36 against support 32. Air between cup 36 and support 32 is decreased by this movement creating a vacuum between cup 36 and support 32 to thereby secure cup 36 and post 10 to support 32.

Figure 3:
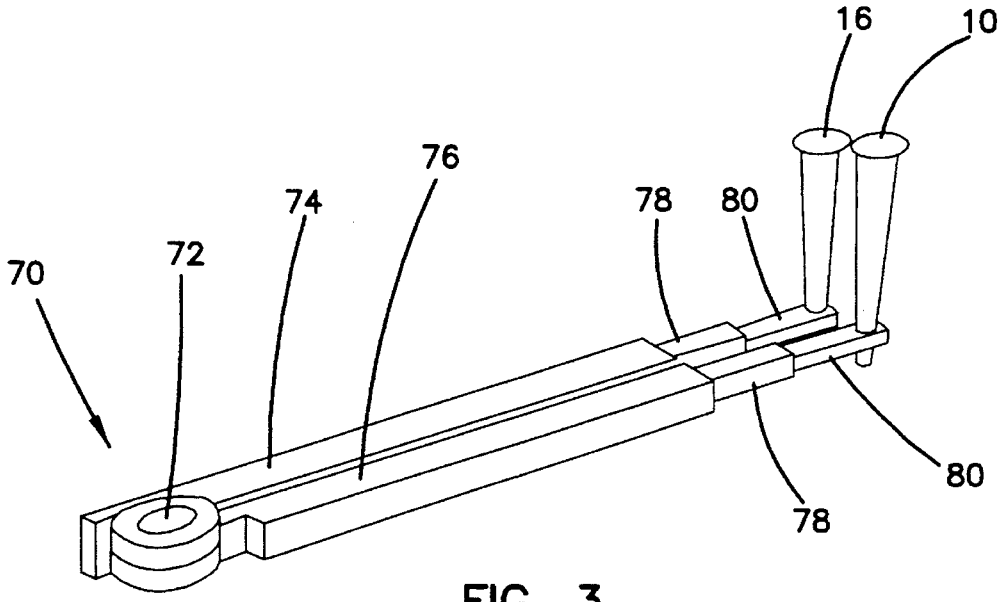
FIG. 3 is a perspective view of an alternative form of the ribbon cutter of the present invention in a collapsed position.
Figure 4:
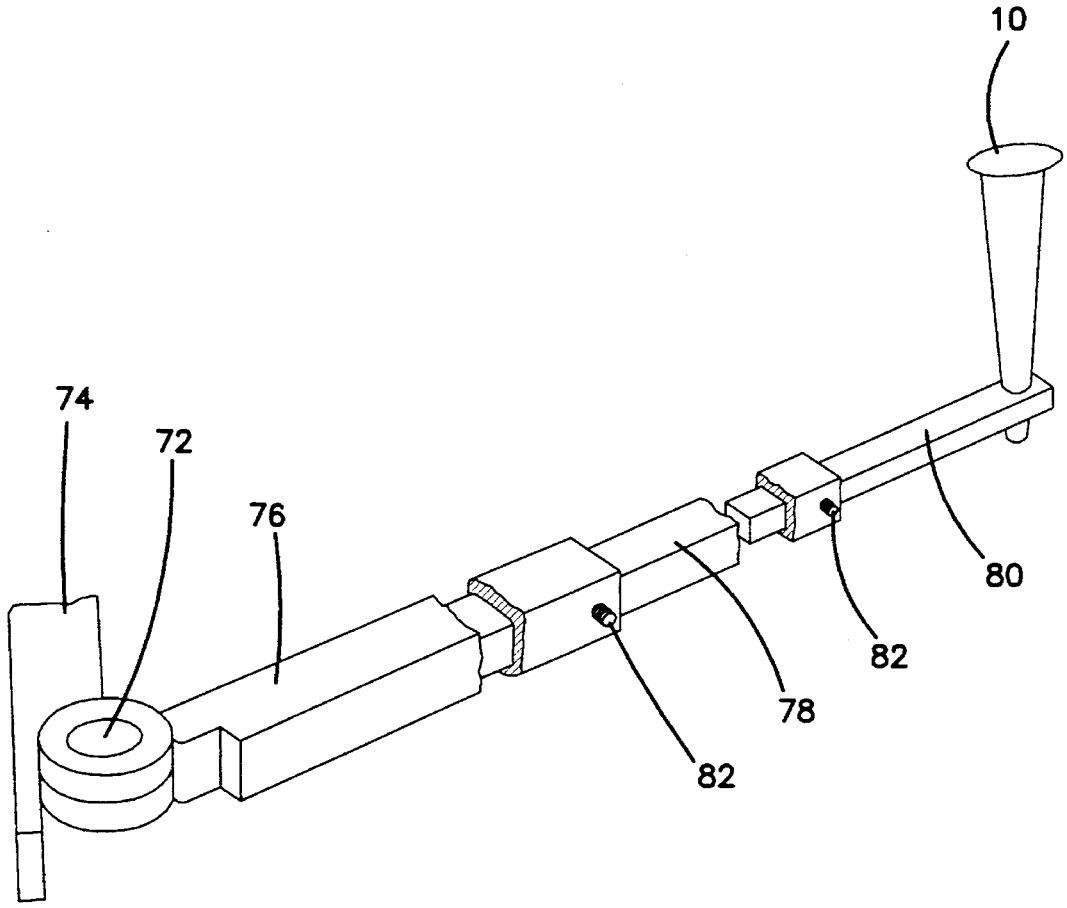
FIG. 4 is a perspective view of the telescoping arm arrangement of the ribbon cutter of FIG. 3.

FIGS. 3 to 6 are an alternative form of the ribbon cutter in accordance with the present invention. Ribbon cutter 70 includes a swing link 72 having upper and lower portions and a first arm 74 add a second arm 76 each having extension members 78 and 80 respectively, coupled to the swing link 72. Side posts 10 and 16 like the side posts 10 and 16 of FIGS. 1A and 1B are connected at the end of each extension member 78 and 80 respectively. The second arm 76 is rotatable or pivotable about the swing link 72 between a fully extended position so that the arms 74 and 76 are polarized and in the same linear path, and a fully collapsed position (as shown in FIG. 3) so that each arm 74 and 76 is substantially parallel to, and nestled compactly against, one another. Extensions 78 and 80 are concentric with the arms 74 and 76 and extend and retract within arms 74 and 76. Screw clamps 82 shown in FIG. 4 can be located on each arm 74 and 76 and on extension 78 for securing the extensions 78 and 80 in any extended or retracted position.

Figure 5:
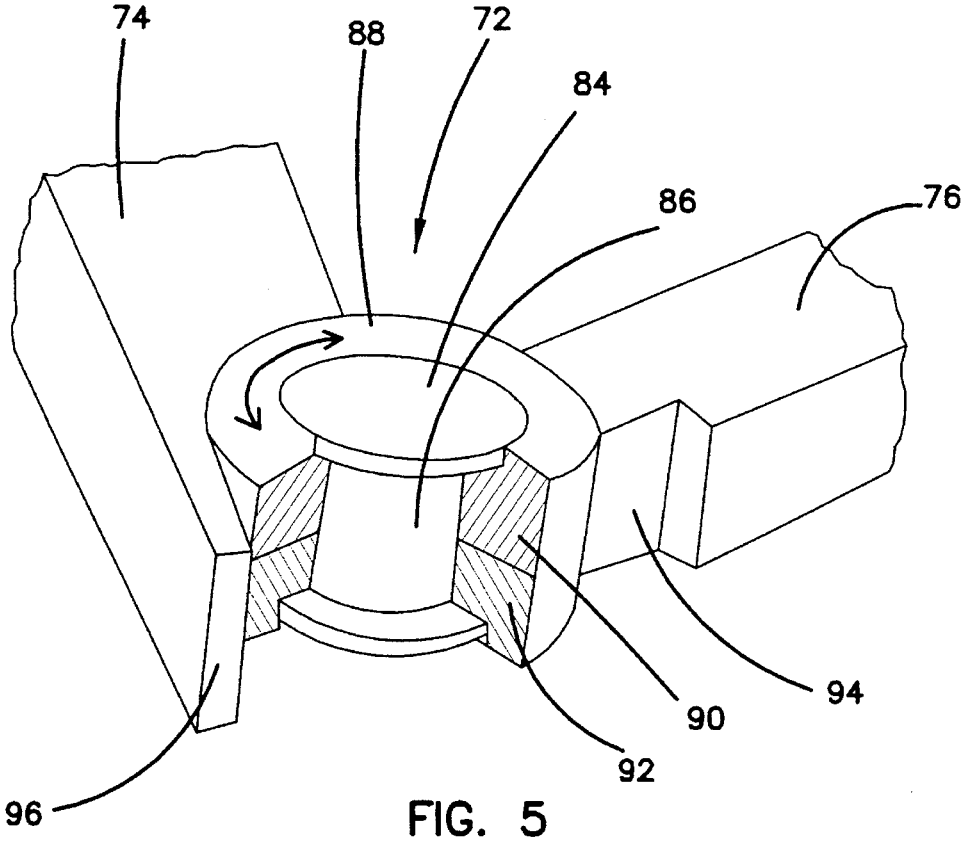
FIG. 5 is a fragmenting perspective view, partly in section, showing arrangement in the device of FIGS. 3 and 4 of a ribbon cutter in accordance with the present invention.
Figure 6:
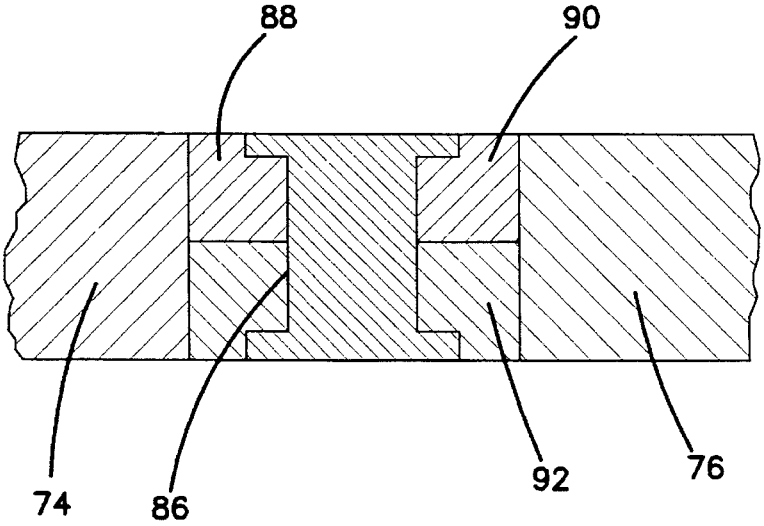
FIG. 6 is a side sectional view of the center swing link of FIG. 5.

FIGS. 5 and 6 illustrate the detail of the center swing link 72 of the ribbon cutter 70 the present invention. Swing link 72 connects arms 74 and 78 to each other. Swing link 72 includes center spool 84 having a center hub 86 and a split outer ring 80. Outer ring 80 contours and surrounds center spool 84 at center hub 86. Outer ring 88 comprises two halves 90 and 92 that have inner surfaces that are formed at angles (as shown in FIG. 6). This allows outer ring 88 to rotate around center spool 84 on center hub 86 smoothly. A notch 94 is provided on arm 76 to allow a finger 96 on arm 74 to mesh with arm 76 at notch 94 when the arms are in a fully polarized position and on the same linear axis when the ribbon cutter is in the fully extended position.

Figure 7:
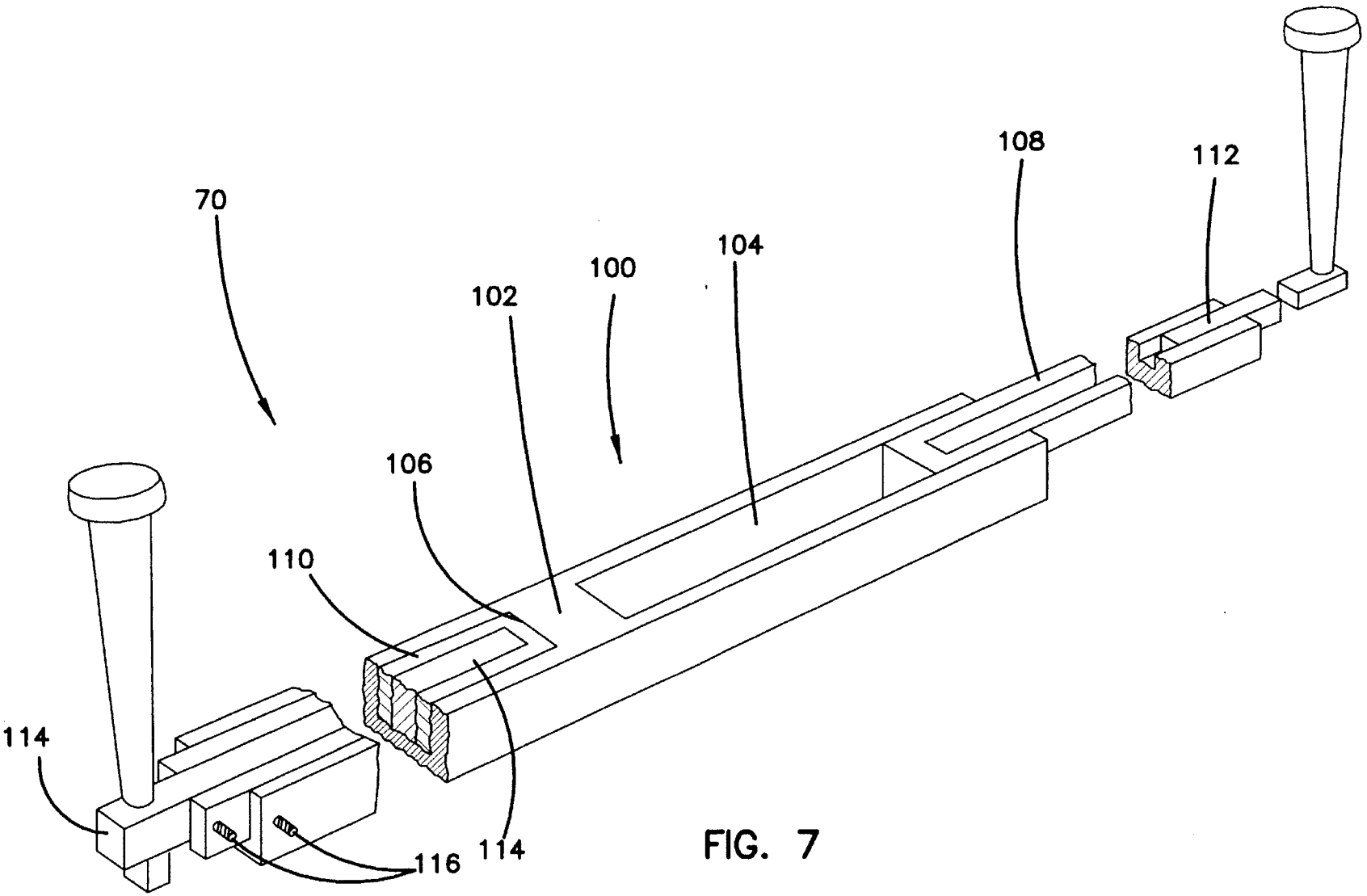
FIG. 7 is a perspective view, partially broken away, of an alternative arrangement of a ribbon cutter device in accordance the present invention.

FIG. 7 illustrates a perspective view of an alternative collapsible arm device of the ribbon cutter 70 of the present invention. The base 100 has a center transverse rib 102 with longitudinal grooves 104 and 106 on opposite sides of the rib 102. Extensions 108, 110, 112 and 114 are incrementally smaller elongated elements each including a groove for receiving the respective larger element. Thus, extensions 112 and 114 extend and collapse comfortably within extensions 108 and 110 respectively and extensions 108 and 110 extend and collapse comfortably within each respective groove 104 and 106. A screw clamp 116 can be located on base 100 and extension 110 for securing the extensions 108, 110, 112, and 114 in any extended or retracted position.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An adjustable ribbon cutter for enabling the cutting of long lengths of rolled ribbon quickly into a plurality of uniform selected lengths of ribbon, comprising:

(a) a first post, including means for removable attachment to a table, for receiving turns of continuous ribbon wrapped thereabout a predetermined number of times;

(b) a second post, including means for removable attachment to the table at a spaced apart chosen distance from the first post, for receiving the turns of the continuous ribbon wrapped thereabout a predetermined number of times such that the turns define a plurality of ribbon spans between the posts; and (c) measurement indicia means, coupled to at least one of the posts and extendable along the table to span at least the first post and the second post and securable to the second post, for indicating the length of ribbon to be formed from a single transverse cut through one of the spans of the ribbon wrapped about the posts.

2. The invention as set forth in claim 1, wherein the means for attaching the first post to the table is a C-clamp fitting over the table edge at a chosen position and the means for attaching the second post to the table is a C-clamp fitting over the table edge at a different chosen position, and wherein the posts both taper outwardly in the direction away from the clamp.

3. The invention as set forth in claim 1, wherein the means for attaching the first post to the table is a suction cup device adherable to the surface to the table and the means for attaching the second post to the table is a suction cup device adherable to the surface to the table and wherein the posts taper outwardly in the direction away from the suction cup devices.

4. An adjustable ribbon cutter for enabling the cutting of long lengths of rolled ribbon quickly into a plurality of uniform selected lengths of ribbon, comprising:

(a) a first post, including means for removable attachment to a table, for receiving turns of continuous ribbon wrapped thereabout a predetermined number of times;

(b) a second post, including means for removable attachment to the table at a spaced apart chosen distance from the first post, for receiving the turns of the continuous ribbon wrapped thereabout a predetermined number of times such that the turns define a plurality of ribbon spans between the posts; the means for attaching the first and second posts to the table including a center base having a first arm and a second arm, the arms being mounted to be compacted with the base for handling, wherein the two posts are located at the end of each arm for continuously receiving the wrapped ribbon a predetermined number of times, and wherein the arms comprise means for relatively moving the arms to space the posts a predetermined distance apart from each other for receiving the turns of the continuous ribbon; and (c) measurement indicia means, located along the table and spanning at least the first post and the second post, for indicating the length of ribbon to be formed from a single transverse cut through one of the spans of the wrapped ribbon.

5. The invention as set forth in claim 4, wherein the center base further comprises a center rib with longitudinal openings on opposite longitudinal ends of the center rib, and the spacing means comprises a plurality of incrementally smaller elongated members each including an opening for incrementally receiving the next smaller elongated member so that the elongated members extend and retract within each other and the two largest elongated members extend and retract within each longitudinal opening of the center base.

6. The invention as set forth in claim 5, wherein each arm and each section of the elongated member further comprises screw clamp means for securing each respective arm and each respective elongated member in any extended or retracted position.

7. An adjustable ribbon cutter for enabling the cutting of long lengths of rolled ribbon quickly into a plurality of uniform selected lengths of ribbon, comprising:

(a) a first post, including means for attachment to a table, for continuously receiving turns of wrapped ribbon a predetermined number of times;

(b) a second post, including means for attachment to the table at a spaced apart predetermined distance from the first post, for continuously receiving the turns of wrapped ribbon the predetermined number of times;

(c) wherein the means for attaching the first and second posts to the table is a center base having a first arm and a second arm, wherein the two side posts are located at the end of each arm for continuously receiving the wrapped ribbon a predetermined number of times, and wherein each arm comprises means for slidably spacing each post a predetermined distance apart from one another, and wherein the center base further comprises a swing link located between and coupled to the arms, wherein the first arm rotates on the swing link between a fully extended position so that the arms are positioned and in the same linear path, and a fully collapsed position so that each arm is parallel to, and nestled compactly against, the other, and wherein the spacing means comprise telescoping elongated members in the arms, including a plurality of incrementally smaller elongated sections that extend and retract within each other; and (d) measurement indicia means, located between the first post and the second post, for indicating the length of ribbon to be formed from a single cut of the wrapped ribbon.

8. The invention as set forth in claim 7, wherein each arm and each section of the elongated member further comprises screw clamp means for securing the position of the elongated sections in any extended or retracted position relative to each other.

9. An adjustable ribbon cutter for enabling the cutting a large quantities of rolled ribbon into a plurality of uniform ribbon lengths quickly, comprising:

(a) an center base having a first arm and a second arm, the first and second arms being movable from a compact position along the base;

(b) two side posts located at the end of each arm for receiving a continuous length of ribbon wrapped about the posts a predetermined number of times;

(c) means, located within each arm, for moving the arms relative to each other to space the posts in positions that are a predetermined distance apart from one other; and (d) measurment indicia means, located on the center base, for indicating the length of the ribbon to be cut by a single cut through the wrapped turns about the spaced apart posts.

10. The invention as set forth in claim 9, wherein the center base further comprises a swing link located between the arms, wherein the first arm rotates about the swing link between a fully extended position so that the arms are in the same linear path, and a fully collapsed position so that each arm is parallel to, and nestled compactly against, one another, and wherein the spacing means comprises a telescoping elongated member comprising a plurality of incrementally smaller elongated sections that extend and retract within each other.

11. The invention as set forth in claim 9, wherein the measurement indicia means comprises measuring marks on the center base and first and second arms corresponding to locations between the posts for indicating cutting length measurements of the ribbon, and wherein the first and second posts vertically extend upward and axially taper outward therefrom and further comprises a flanged cap at a top end of each respective post.

12. The invention as set forth in claim 10, wherein each arm and each section of the elongated member further comprises screw clamp means for securing each respective arm and each respective section in any extended or retracted position.

13. The invention as set forth in claim 9, wherein the center base further comprises a center rib with longitudinal notches on opposite sides of the rib, and the spacing means is a plurality of incrementally smaller elongated members each including a longitudinal recess for incrementally receiving each smaller elongated member so that the elongated members extend and retract within each other and the two largest incremental elongated members extend and retract within each longitudinal recess of the center base.

14. The invention as set forth in claim 13, wherein each arm and each section of the elongated member further comprises screw clamp means for securing each respective arm and each respective elongated member in any extended or retracted position.

15. An adjustable ribbon cutter for enabling the cutting of long lengths of rolled ribbon quickly into a plurality of uniform selected lengths of ribbon, comprising:

(a) a first post, including means for attachment to a table, for continuously receiving turns of wrapped ribbon a predetermined number of times;

(b) a second post, including means for attachment to the table at a spaced apart predetermined distance from the first post, for continuously receiving the turns of wrapped ribbon a predetermined number of times; and (c) measurement indicia means, located between the first post and the second post, for indicating the length of ribbon to be formed from a single cut of the wrapped ribbon, the measurement indicia means comprising a measuring device located on the second post and extending to, and releasably connected on, the first post including marked means corresponding to locations between the posts for indicating cutting length measurements of the ribbon, and wherein the first and second posts taper vertically upward and axially taper outward therefrom and further each comprise a flanged cap at a top end of each respective post.

* * * * *